US009839260B1

(12) United States Patent
Chang

(10) Patent No.: US 9,839,260 B1
(45) Date of Patent: Dec. 12, 2017

(54) PNEUMATIC INSOLE

(71) Applicant: Chi-Yuan Chang, Taichung (TW)

(72) Inventor: Chi-Yuan Chang, Taichung (TW)

( * ) Notice: Subject to any disclaimer, the term of this patent is extended or adjusted under 35 U.S.C. 154(b) by 1 day.

(21) Appl. No.: 15/219,349

(22) Filed: Jul. 26, 2016

(51) Int. Cl.
*A43B 17/03* (2006.01)
*A43B 7/14* (2006.01)

(52) U.S. Cl.
CPC ..... *A43B 17/035* (2013.01); *A43B 7/141* (2013.01); *A43B 7/1445* (2013.01); *A43B 17/03* (2013.01)

(58) Field of Classification Search
CPC ..... A43B 13/38; A43B 13/386; A43B 17/00; A43B 17/02; A43B 17/026; A43B 17/03; A43B 17/035
USPC ..... 36/43, 44, 29
See application file for complete search history.

(56) References Cited

U.S. PATENT DOCUMENTS 2,080,499 A * 5/1937 Nathansohn ..... A43B 17/03 36/153
3,765,422 A * 10/1973 Smith ..... A43B 17/03 36/153
3,871,117 A * 3/1975 Richmond ..... A43B 17/035 36/29
4,219,945 A * 9/1980 Rudy ..... A43B 13/203 36/29
4,700,403 A * 10/1987 Vacanti ..... A63B 71/08 2/22
4,885,849 A * 12/1989 Lambert ..... A43B 17/08 36/147
5,067,255 A * 11/1991 Hutcheson ..... A43B 17/026 36/28
5,784,807 A * 7/1998 Pagel ..... A43B 1/0009 36/153
5,846,063 A * 12/1998 Lakic ..... A42B 3/122 2/413
5,878,510 A * 3/1999 Schoesler ..... A43B 7/147 36/153
6,092,310 A * 7/2000 Schoesler ..... A43B 17/035 36/153
7,917,981 B1 * 4/2011 Lakic ..... A43B 7/24 12/142 R
2003/0046831 A1 * 3/2003 Westin ..... A43B 13/187 36/29

FOREIGN PATENT DOCUMENTS

TW M380726 U 5/2010
TW M503777 U 7/2015

* cited by examiner

*Primary Examiner* — Marie Bays
(74) *Attorney, Agent, or Firm* — Alan D. Kamrath; Kamrath IP Lawfirm, P.A.

(57) ABSTRACT

A pneumatic insole includes airbags, channels, two arch-related chambers, a push-type inlet valve, an inlet channel, a check valve, a recessed portion, a push-type adjustment valve, and an outlet channel. The channels interconnect the airbags. The push-type inlet valve is located in the first arch-related chamber. The inlet channel connects the first arch-related chamber to a leading one of the airbags. The check valve is arranged between the inlet channel and the inlet airbag. The recessed portion is located between the arch-related chambers. The push-type adjustment valve is located in the recessed portion and formed with an upper face that extends lower than that of the first and second arch-related chambers. The outlet channel connects the push-type adjustment valve to another one of the airbags.

9 Claims, 6 Drawing Sheets

PNEUMATIC INSOLE

BACKGROUND OF INVENTION

1. Field of Invention

The present invention relates to insoles and, more particularly, to a pneumatic insole.

2. Related Prior Art

Many pneumatic insoles have been devised. For example, Taiwanese Patent No. M380726 discloses a pneumatic insole assembly that includes airbags provided on an insole. Each of the airbags includes a valve. Air is pumped into the airbags via the valves. However, the pneumatic insole assembly does not include any built-in pump so that the airbags are inflated by an external device such as a pump, and this is inconvenient. Moreover, the insole does not include any valve for releasing air when the airbags are excessively inflated so that the extent to which the airbags is inflated is not adjustable, and this is not desirable.

Taiwanese Patent No. M503777 discloses an insole assembly that includes an airbag and a pump provided on an insole. The airbag and the pump are located on a portion of the insole corresponding to an arch of a foot. When the arch of the foot collapses because of fatigue, the collapsed arch of the foot presses the pump to inflate the airbag to support the collapsed arch of the foot. However, the heel of the foot could press the pump to inflate the airbag by accident.

Moreover, a conventional airbag for a pneumatic insole is made of rubber or plastics. These materials exhibit capillarity that allows air to leak from the airbag after two or three months of use so that the airbag is inflated and non-elastic and loses the ability to cushion. An attempt to solve this problem is filling inert gas in the airbag. However, this attempt is ineffective. Another attempt to solve this problem is increasing the thickness of the material used to make the airbag. This attempt is ineffective. Moreover, it increases the weight of airbag.

The present invention is therefore intended to obviate or at least alleviate the problems encountered in prior art.

SUMMARY OF INVENTION

It is the primary objective of the present invention to provide a convenient and reliable pneumatic insole.

To achieve the foregoing objective, the pneumatic insole includes airbags, channels, two arch-related chambers, a push-type inlet valve, an inlet channel, a check valve, a recessed portion, a push-type adjustment valve and an outlet channel. The channels interconnect the airbags. The push-type inlet valve is located in the first arch-related chamber. The inlet channel connects the first arch-related chamber to a leading one of the airbags. The check valve is arranged between the inlet channel and the inlet airbag. The recessed portion is located between the arch-related chambers. The push-type adjustment valve is located in the recessed portion and formed with an upper face that extends lower than that of the arch-related chambers. The outlet channel connects the push-type adjustment valve to another one of the airbags.

Advantageously, the push-type inlet and outlet valves render it convenient to inflate the arch-related air chambers and the airbags to a desired extent.

Moreover, the push-type inlet and outlet valves render it convenient to pump air into the arch-related air chambers and the airbags after some of original air leaks from them.

The push-type inlet valve will not be pushed to pump more air into the air chambers and the airbags by mistake because the push-type inlet valve is located in the first arch-related chamber and will not be pushed by the arch of a foot.

The push-type adjustment valve will not be pushed to release some of the air from the air chambers and the airbags by mistake because the upper face of the push-type adjustment valve extends lower than that of the chambers.

In another aspect, the pneumatic insole further includes two support units each inserted in a corresponding one of the arch-related chambers. Each of the support units includes an elastic block located on a pad. The elastic block is made with better elasticity than the pad.

Advantageously, the support units enable the arch-related portion of the pneumatic insole to provide proper support for the arch of the foot.

In another aspect, the pneumatic insole further includes elastic blocks inserted in some of the airbags that are located in a heel-related portion of the pneumatic insole.

Advantageously, the elastic blocks enable the heel-related portion of the pneumatic insole to provide proper support for the heel of the foot.

In another aspect, the pneumatic insole further includes a connective airbag for interconnecting the arch-related chambers.

Advantageously, the support units enable the arch-related portion of the pneumatic insole to provide proper support for the entire arch of the foot.

In another aspect, the pneumatic insole further includes a margin that can be cut.

Advantageously, the pneumatic insole can fit a shoe in which the pneumatic insole is to be used.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
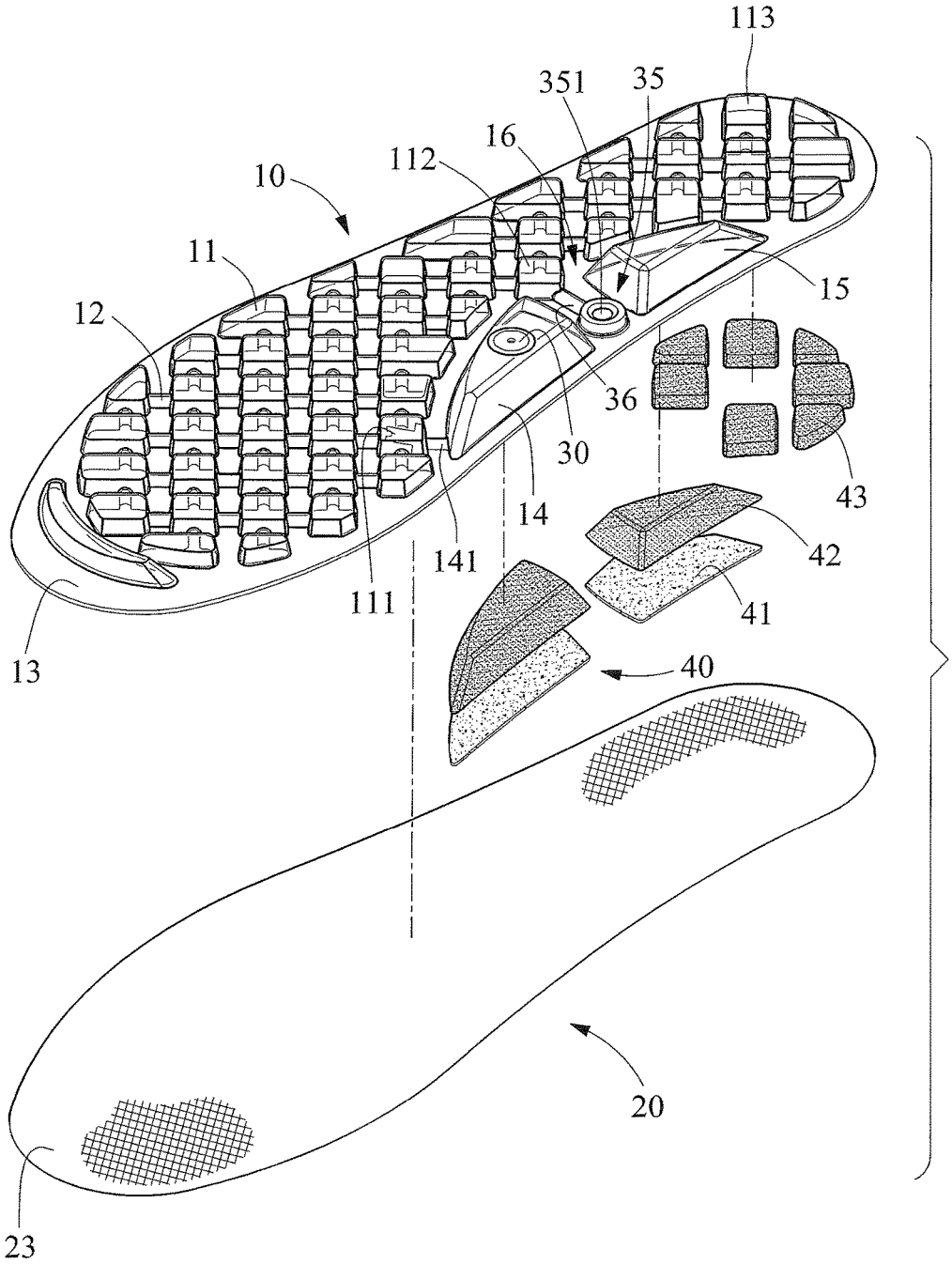
FIG. 1 is an exploded view of a pneumatic insole according to the first embodiment of the present invention.
Figure 2:
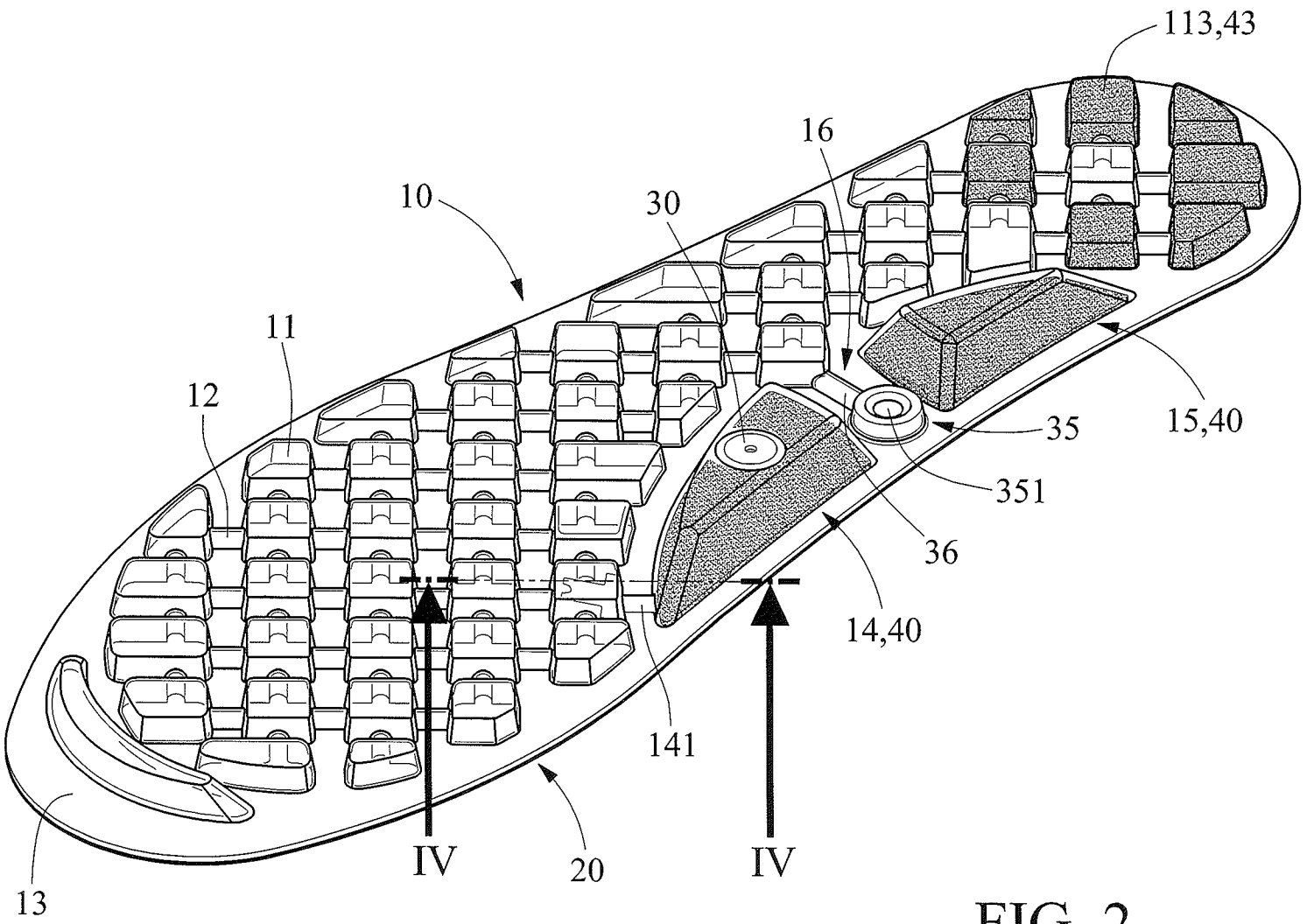
FIG. 2 is a perspective view of the pneumatic insole shown in FIG. 1.
Figure 3:
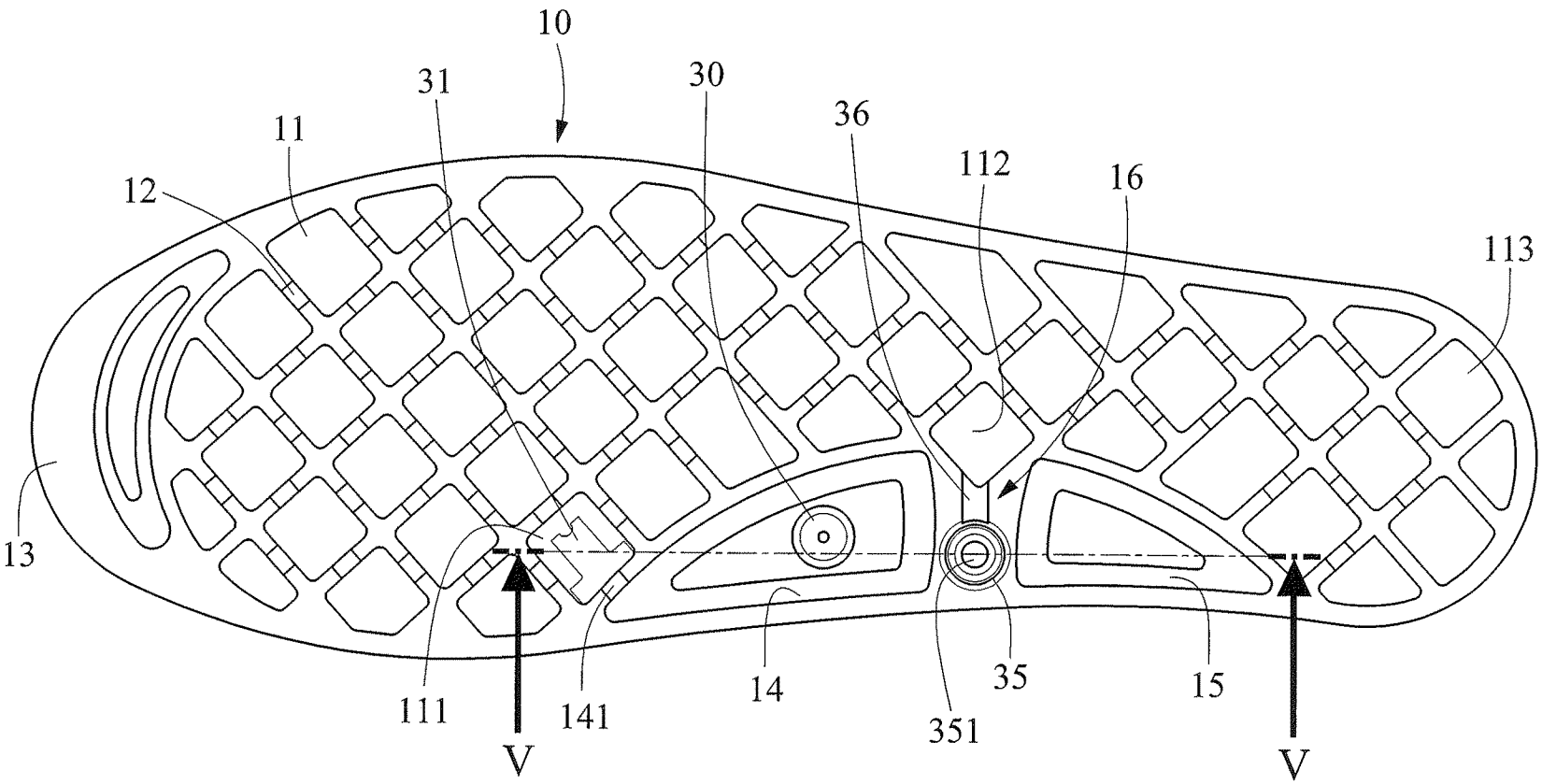
FIG. 3 is a top view of the pneumatic insole shown in FIG. 2.

Referring to FIGS. 1 through 3, a pneumatic insole includes an upper layer 10 and a lower layer 20 according to a first embodiment of the present invention. By thermoplastic molding, the upper layer 10 is provided with airbags 11 and channels 12 via which the airbags 11 are in communication of air with one another. The upper layer 10 includes a margin 13 that is connected to a margin 23 of the lower layer 20 by melting technology so that there is air-tightness between the upper and lower layers 10 and 20. The margins 13 and 23 of the upper and lower layers 10 and 20 of the pneumatic insole can be cut or trimmed to fit a particular size and shape of a shoe, boot or sneaker in which the pneumatic insole is to be used.

The pneumatic insole includes two arch-related chambers 14 and 15 in an arch-related portion. The arch-related chamber 14 includes a push-type inlet valve 30. The arch-related chamber 14 is in communication with one of the airbags 11 (further referred to by "the leading airbag 111" for convenience of the description) via an inlet channel 141. A check valve 31 is inserted in the inlet airbag 111. However, the check valve 31 can be inserted in the inlet channel 141 or arranged between the inlet airbag 111 and the inlet channel 141.

Figure 4:
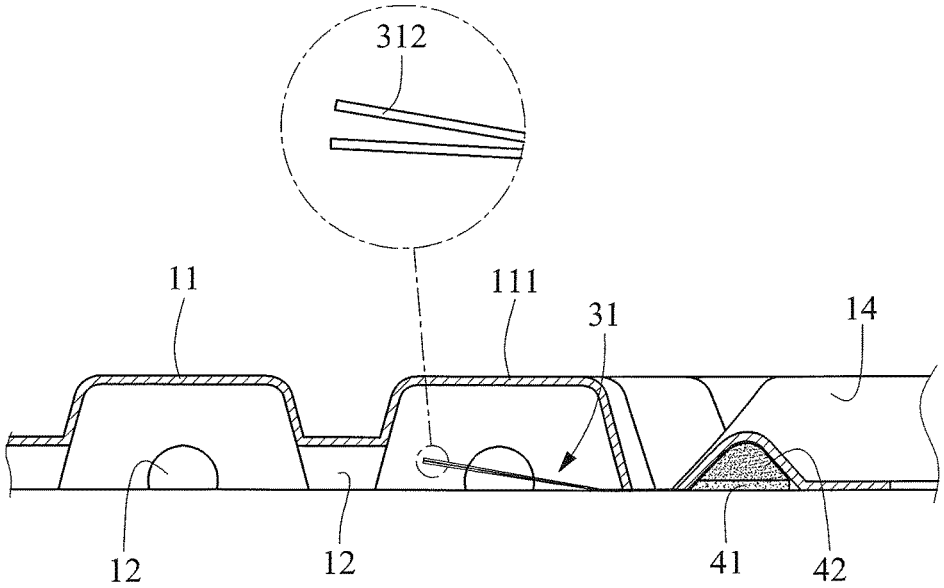
FIG. 4 is a partial, cross-sectional view of the pneumatic insole shown in FIG. 2.

Referring to FIG. 4, the check valve 31 is a thin-film tube that includes two an inlet (not numbered) at an end and an outlet 312 at another end. The inlet of the check valve 31 is in communication with the inlet channel 141. The outlet 312 is in communication with the inlet airbag 111. The outlet 312 includes a two thin films or flips. Air that travels from the inlet channel 141 opens the outlet 312 of the check valve 31 and enters the airbag 111. In an attempt to travel from the airbag 111 to the inlet channel 141, the air closes the outlet 312 of the check valve 31 so that the air cannot return into the inlet channel 141 from the airbag 111.

The upper layer 10 includes a recessed portion 16 between the arch-related chamber 14 and the arch-related chamber 15. The upper layer 10 includes, in the recessed portion 16, a push-type adjustment valve 35 and an outlet channel 36. The outlet channel 36 is in communication with the push-type adjustment valve 35 at an end and in communication with another one of the airbags 11 (further referred to by "the outlet airbag 112" for convenience of the description) at another end.

Figure 5:
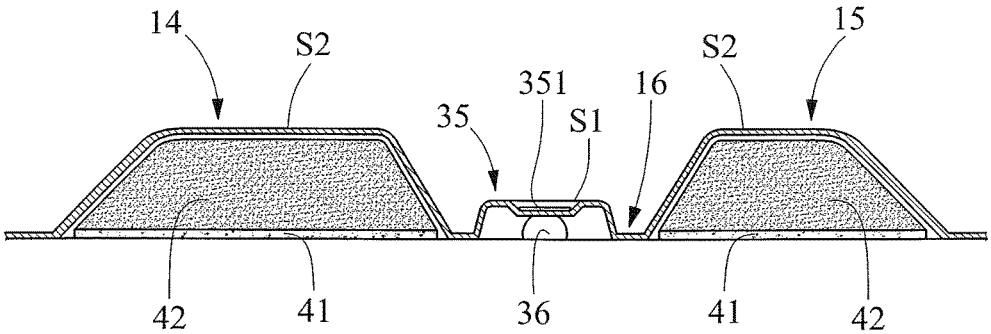
FIG. 5 is another partial, cross-sectional view of the pneumatic insole shown in FIG. 2.

Referring to FIG. 5, the push-type adjustment valve 35 includes an upper face S1 that extends lower than the upper faces S2 of the arch-related chambers 14 and 15. The push-button 351 includes an upper face (not numbered) that extends lower than the upper face S1 of the push-type adjustment valve 35.

Referring to FIGS. 1, 2 and 5, a support unit 40 is inserted in each of the arch-related chambers 14 and 15. Each of the support units 40 includes a pad 41 and an elastic block 42 located on the pad 41. The pads 41 and the elastic blocks 42 are made of foam materials and provided with a color. However, the elastic blocks 42 are made with better elasticity than the pads 41. Some others of the airbags 11 (further referred to by "the airbags 113" for convenience of the description) are located in a heel-related portion of the pneumatic insole. An elastic block 43 is inserted in each of the airbags 113. The elastic block 43 is provided with a color.

Figure 6:
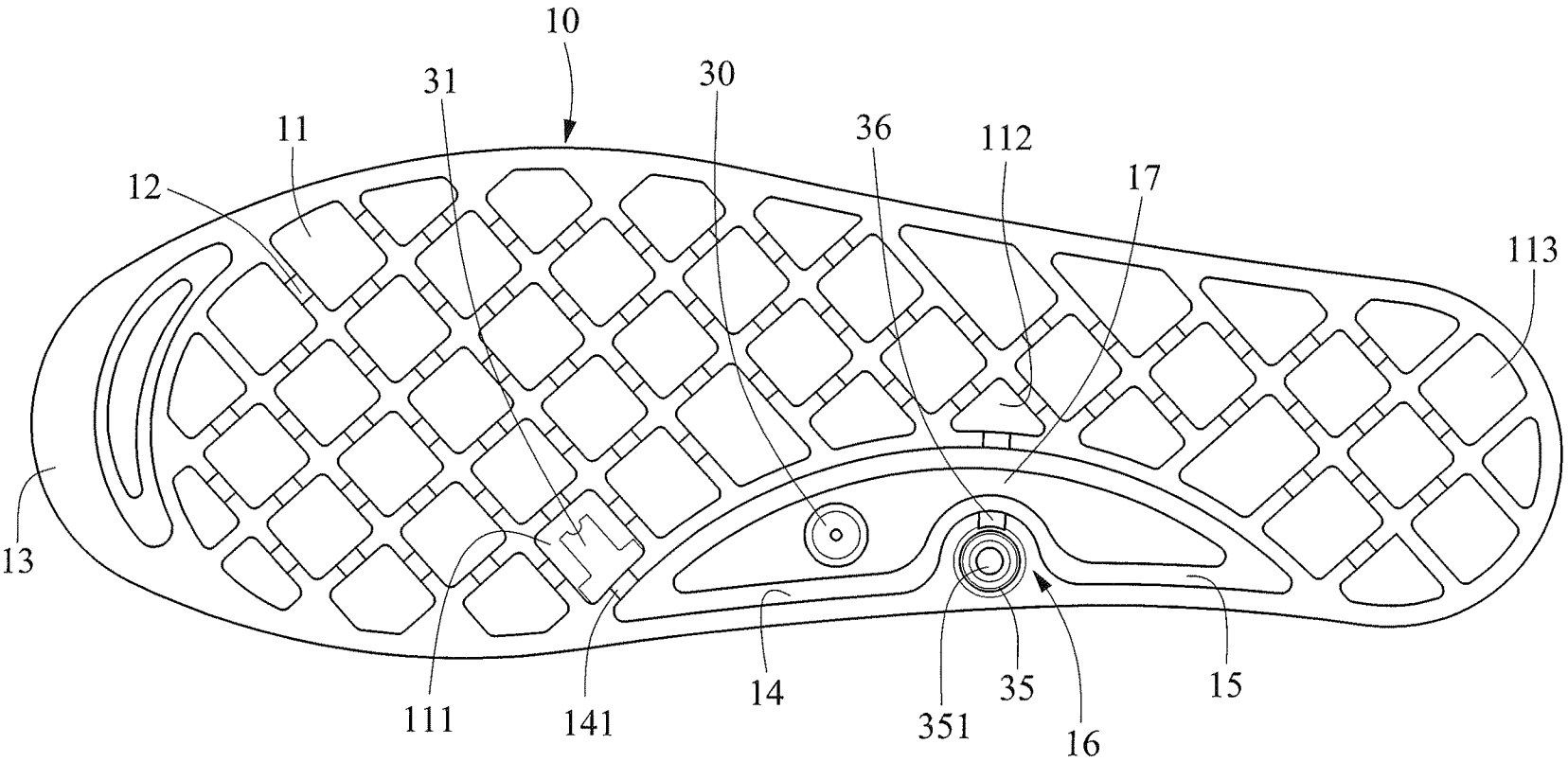
FIG. 6 is a top view of a pneumatic insole according to the second embodiment of the present invention.

Referring to FIG. 6, there is a pneumatic insole according to a second embodiment of the present invention. The second embodiment is identical to the first embodiment except for two things. Firstly, there is a connective airbag 17 via which the arch-related chamber 14 is communication with the arch-related chamber 15. Secondly, the recessed portion 16, which is located between the arch-related chamber 14 and the arch-related chamber 15, is reduced in size. The connective airbag 17 extends over the outlet channel 36. That is, the connective airbag 17 and the outlet channel 36 do not interfere with each other.

Before the pneumatic insole is used, all of the airbags 11, which includes the airbags 111, 112 and 113, must be inflated. The arch-related chamber 14 is pressed to actuate the push-type inlet valve 30 to pump air into the airbag 111 from the exterior via the arch-related chamber 14, inlet channel 141 and the check valve 31. Since all of the airbags 11 are interconnected by the channels 12, the air travels into the other airbags 11 from the airbag 111 via the channels 12. The pressing of the arch-related chamber 14 is continued so that all of the airbags 11 are inflated to an extent desired by a user. If the airbags 11 are somehow excessively inflated, the push-type adjustment valve 35 can be pressed to cause some of the air to travel into the outlet airbag 112 from the other airbags 11 via the channels 12 and then travels to the exterior from the outlet airbag 112 via the outlet channel 36 and the push-type adjustment valve 35. The pressing of the push-type adjustment valve 35 is repeated to release an excessive portion of the air to the exterior.

Figure 7:
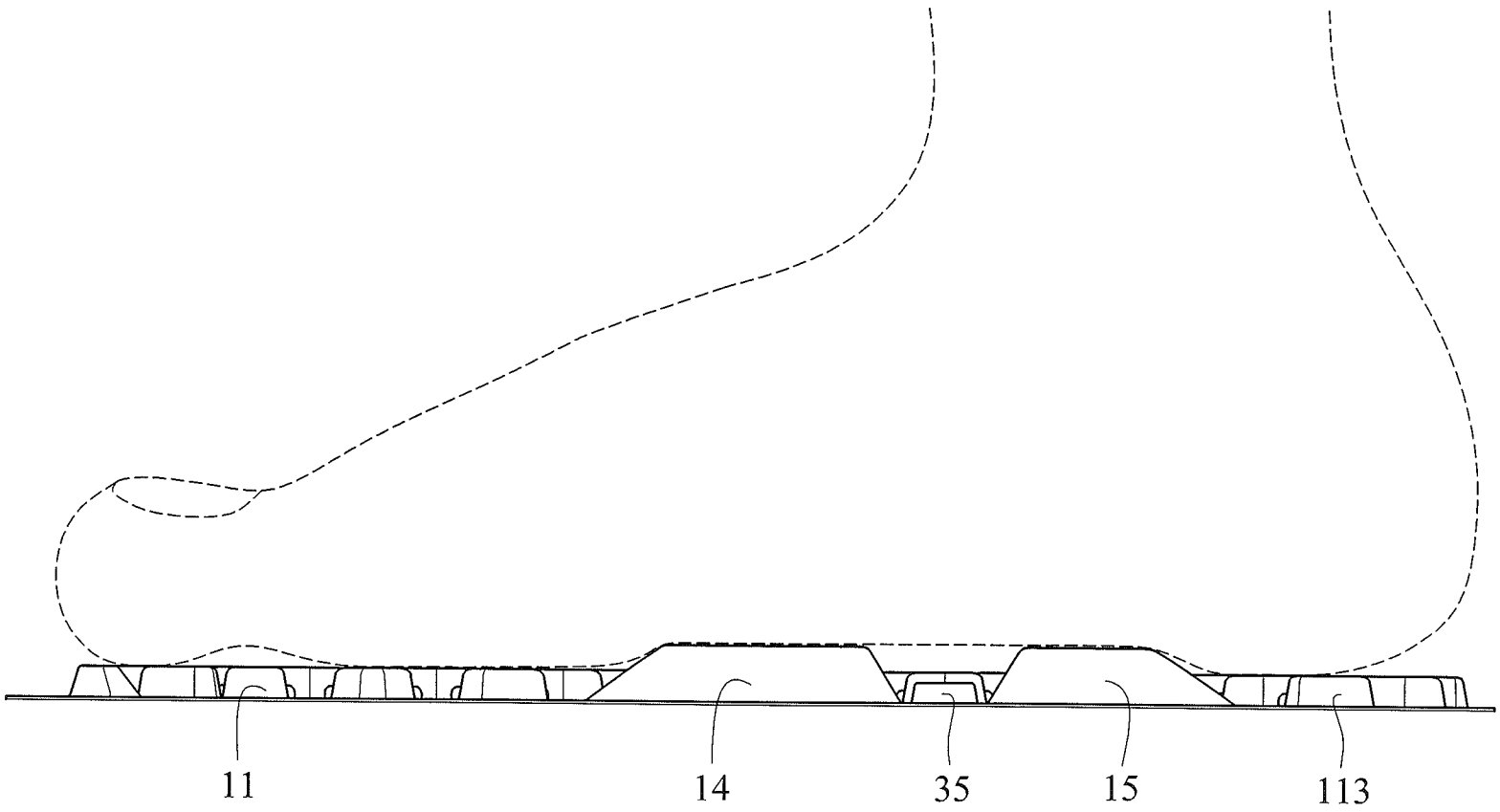
FIG. 7 is a side view of a foot supported on the pneumatic insole shown in FIG. 1.

Referring to FIG. 7, the pneumatic insole is put in a shoe, boot or sneaker. A user puts his or her foot in the shoe, boot or sneaker, i.e., sets the foot on the airbags 11. The arch of the foot is supported on the arch-related chamber 14 and the arch-related chamber 15. The airbags 11, which include the airbags 111, 112 and 113, provides the foot with proper cushioning. The airbags 113, which are located in the heel-related portion of the pneumatic insole, are used with the soft and elastic blocks 43 to provide the foot with further cushioning. When the user stands or walks, the arch of the foot is kept from the arch-related chamber 14 and arch-related chamber 15. Hence, the push-type inlet valve 30 will not be actuated to further inflate the airbags 11 by mistake. Moreover, the upper face S1 of the push-type adjustment valve 35 extends lower than the upper faces S2 of the arch-related chambers 14 and 15, and the upper face of the push-button 351 extends lower than the upper face S1 of the push-type adjustment valve 35. Hence, the arch of the foot is kept from the push-type adjustment valve 35 and the push-button 351. Accordingly, the push-type adjustment valve 35 will not be actuated to flat the airbags 11 by mistake.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A pneumatic insole comprising:

at least one inlet airbag (111), at least one outlet airbag (112) and at least one heel-related airbag (113);

channels (12) for interconnecting the airbags (111, 112, 113);

a first arch-related chamber (14);

a second arch-related chamber (15);

a push-type inlet valve (30) located in the first arch-related chamber (14);

an inlet channel (141) for connecting the first arch-related chamber (14) to the inlet airbag (111);

a check valve (31) arranged between the inlet channel (141) and the inlet airbag (111);

a recessed portion (116) between the first and second arch-related chambers (14, 15);

a push-type adjustment valve (35) located in the recessed portion (116) and formed with an upper face that extends lower than that of the first and second arch-related chambers (14, 15); and an outlet channel (36) for connecting the push-type adjustment valve (35) to the outlet airbag (112).

2. The pneumatic insole according to claim 1, further comprises two support units (40) each inserted in a corresponding one of the first and second arch-related chambers (14, 15).

3. The pneumatic insole according to claim 2, wherein each of the support units (40) comprises a pad (41) and an elastic block (42) located on the pad (41), wherein the elastic block (42) is made with better elasticity than the pad (41).

4. The pneumatic insole according to claim 1, further comprising elastic blocks (43) inserted in some of the airbags (113) that are located in a heel-related portion of the pneumatic insole.

5. The pneumatic insole according to claim 4, wherein each of the elastic blocks (42) is provided with a color.

6. The pneumatic insole according to claim 1, wherein the push-type adjustment valve (35) is made with an upper face (S1) that extends higher than that of the push-button (351).

7. The pneumatic insole according to claim 1, further comprising a connective airbag (17) for interconnecting the first and second arch-related chambers (14, 15).

8. A pneumatic insole comprising an upper layer (10) and a lower layer (20) attached to the upper layer (10) in an air-tight manner so that the pneumatic insole comprises:

at least one inlet airbag (111), at least one outlet airbag (112) and at least one heel-related airbag (113);

channels (12) for interconnecting the airbags (111, 112, 113);

a first arch-related chamber (14);

a second arch-related chamber (15);

a push-type inlet valve (30) located in the first arch-related chamber (14);

an inlet channel (141) for connecting the first arch-related chamber (14) to the inlet airbag (111);

a check valve (31) arranged between the inlet channel (141) and the inlet airbag (111);

a recessed portion (116) between the first and second arch-related chambers (14, 15);

a push-type adjustment valve (35) located in the recessed portion (116) and formed with an upper face that extends lower than that of the first and second arch-related chambers (14, 15); and an outlet channel (36) for connecting the push-type adjustment valve (35) to the outlet airbag (112).

9. The pneumatic insole according to claim 1, wherein each of the upper and lower layers (10, 20) comprises a margin (13, 23) that can be cut to fit a shoe in which the pneumatic insole is to be used.

* * * * *